US007769321B2

(12) United States Patent
Tanaka

(10) Patent No.: US 7,769,321 B2
(45) Date of Patent: Aug. 3, 2010

(54) FUNCTIONAL UNIT LOCKING APPARATUS AND IMAGE FORMING APPARATUS INCLUDING THE FUNCTIONAL UNIT LOCKING APPARATUS

(75) Inventor: Shuji Tanaka, Ohta-ku (JP)

(73) Assignee: Ricoh Company, Limited, Tokyo (JP)

( * ) Notice: Subject to any disclaimer, the term of this patent is extended or adjusted under 35 U.S.C. 154(b) by 964 days.

(21) Appl. No.: 11/547,174

(22) PCT Filed: Feb. 9, 2006

(86) PCT No.: PCT/JP2006/302677

§ 371 (c)(1),
(2), (4) Date: Oct. 2, 2006

(87) PCT Pub. No.: WO2006/085680

PCT Pub. Date: Aug. 17, 2006

(65) Prior Publication Data

US 2007/0147884 A1 Jun. 28, 2007

(30) Foreign Application Priority Data

Feb. 9, 2005 (JP) ..... 2005-033686

(51) Int. Cl.
*G03G 21/16* (2006.01)

(52) U.S. Cl. ..... 399/111

(58) Field of Classification Search ..... 399/111, 399/112, 114, 262

See application file for complete search history.

(56) References Cited

U.S. PATENT DOCUMENTS

| | | | | |
|---|---|---|---|---|
| 5,134,443 | A | * | 7/1992 | Sumi et al. |
| 5,745,825 | A | | 4/1998 | Okawa et al. |
| 5,819,139 | A | | 10/1998 | Harlan et al. |

FOREIGN PATENT DOCUMENTS

| | | | |
|---|---|---|---|
| JP | 8-83034 | A | 3/1996 |
| JP | 8 314216 | | 11/1996 |
| JP | 2002 287447 | | 10/2002 |
| JP | 2003 248411 | | 9/2003 |
| JP | 2004 227018 | | 8/2004 |
| JP | 2004 240354 | | 8/2004 |

OTHER PUBLICATIONS

Machine Translation of Goto (JP Pub. 08-083034), already presented in 1449 dated Jul. 30, 2009, furnished for applicants' benefit.*

* cited by examiner

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

After a functional unit is pushed into the innermost position within the image forming apparatus main body, the unit is locked to the image forming apparatus main body by engaging a first locking member pivotally attached to a casing of the unit with a second locking member held by the casing to be movable vertically and by bringing the second locking member in pressure contact with a restricting member fixed to the image forming apparatus main body.

10 Claims, 11 Drawing Sheets

FUNCTIONAL UNIT LOCKING APPARATUS AND IMAGE FORMING APPARATUS INCLUDING THE FUNCTIONAL UNIT LOCKING APPARATUS

TECHNICAL FIELD

The present invention relates to a functional unit that is detachably attached to a body of an image forming apparatus, and an image forming apparatus including the unit.

BACKGROUND ART

It is common to detachably attach various functional units to the main body of image forming apparatuses such as electronic copying machines, printers, facsimile machines, and multifunction products. A process cartridges, which is disclosed in Patent Document 1, having an image carrier, a developing unit, a cleaning unit, a fixing unit, and an intermediate transfer unit is an example of the functional unit. Such functional units are generally set deep inside the main body of the image forming apparatus. If the functional unit is not set in its usual position, and if the image forming operation starts, an abnormal image can be formed, or, parts in the image forming apparatus can get damaged.

There is a known configuration in which, at the time of attaching a face plate to a front plate of the image forming apparatus main body, the functional unit is pushed in and positioned at the innermost position within the image forming apparatus main body by the face plate, and the functional unit is locked at that position. According to this configuration, since the functional unit can be locked at a predetermined attaching position within the image forming apparatus main body, occurrence of the drawback described above can be prevented. However, when the functional unit is pushed in by the face plate, large external force is applied to the face plate from the functional unit, and the face plate can be largely elastically deformed. In such case, since the face plate serves to position respective elements within the image forming apparatus main body, positions of the elements to be positioned by the face plate may deviate from predetermined positions.

Patent Document 1: Japanese Patent Application Laid-Open No. 2004-240354

DISCLOSURE OF INVENTION

Problem to be Solved by the Invention

It is an object of the present invention to provide a functional unit that can be surely and correctly positioned in it position and locked to an image forming apparatus main body, and an image forming apparatus including the functional unit.

Means for Solving Problem

To solve the problem and achieve the object, an aspect of the present invention provides a functional unit that is detachably attached to an image forming apparatus main body in front and rear directions, including a first locking member that is pivotally supported by a casing of the functional unit, and a second locking member that is held to the casing to be movable in a direction of approaching to or separating from the first locking member and is pressed in a direction of approaching to the first locking member by a restricting member provided on the image forming apparatus main body when the functional unit has been pushed into an innermost position within the image forming apparatus main body, where the first locking member and the second locking member are arranged in the casing such that, when the functional unit is drawn to a front side, and the second locking member and the restricting member are disengaged from each other, the first locking member can be freely pivoted within a predetermined angular range, and when the first locking member is pivoted at a locking position where the first locking member engages with the second locking member pressed by the restricting member while the functional unit has been pushed into the innermost position within the image forming apparatus main body, the first locking member frictionally engages with the second locking member where the first locking member is engaged at the locking position, and the second locking member and the restricting member come in pressure contact with each other, so that the functional unit is locked to the image forming apparatus main body.

According to another aspect, the first locking member also serves as a handle that is grasped by an operator at attaching and detaching times of the functional unit.

According to still another aspect, the functional unit further includes a biasing unit that biases the first locking member toward an unlocking position except for the locking position.

According to still another aspect, the first locking member includes a pair of arm portions and a coupling portion connecting the arm portions to each other, a proximal end of each arm portion is pivotally coupled to the casing of the functional unit, the casing has guide portions on which the respective arm portions slide when the first locking member is pivoted between the locking position and the unlocking portion, the guide portion guides both the arm portions such that a distance between both the arm portions gradually expands when the first locking member is pivoted from the unlocking position to the locking position, and the biasing unit is constituted by the guide portions.

According to still another aspect, the biasing unit includes a spring that biases the first locking member toward the unlocking position.

According to still another aspect, the functional unit includes an image carrier on which a toner image is formed.

According to still another aspect, an image forming apparatus includes the functional unit according to the above aspects.

Effect of the Invention

According to the present invention, a functional unit can be Surely and correctly positioned in its proper position and locked.

EXPLANATIONS OF LETTERS OR NUMERALS

Figure 1:
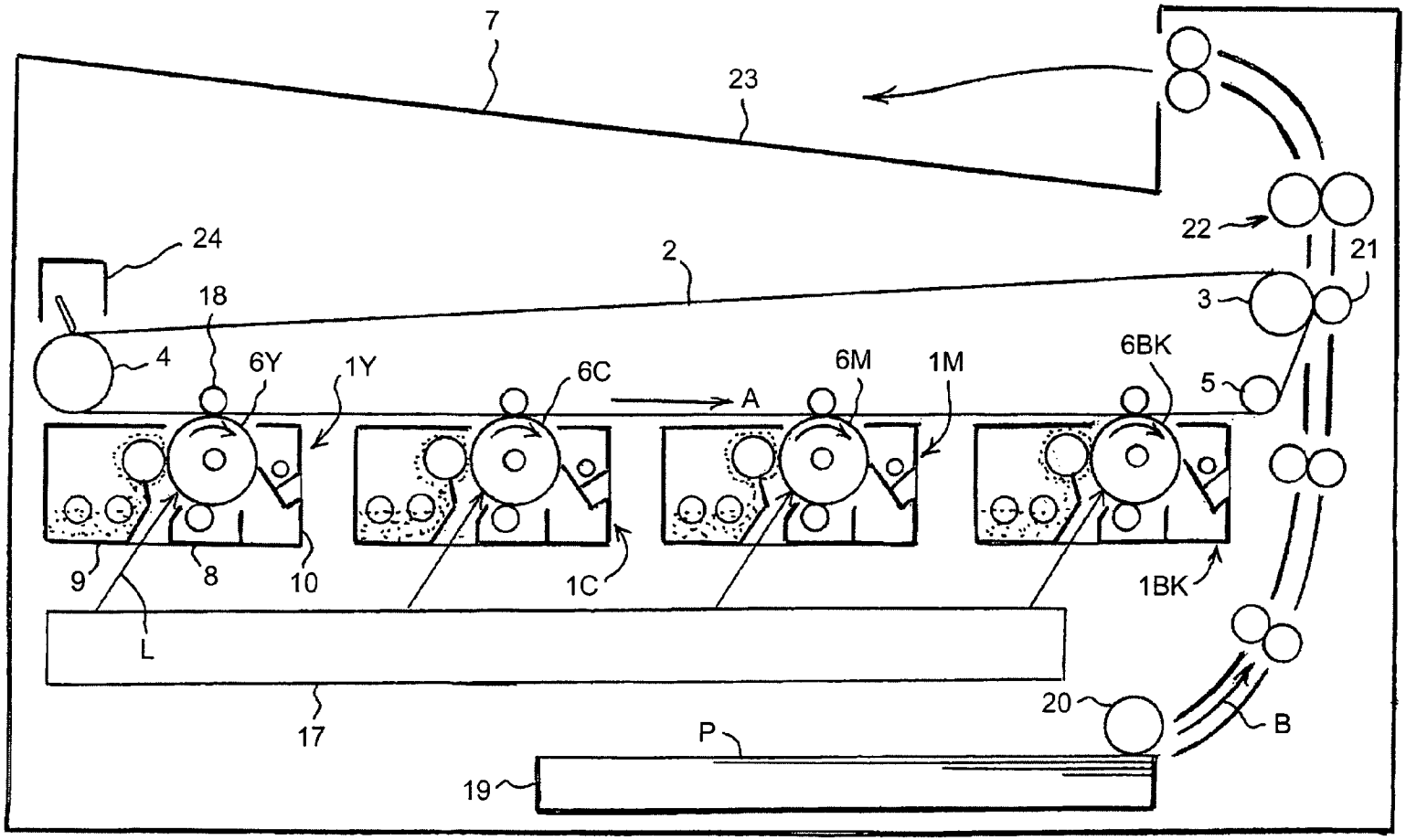
FIG. 1 is a schematic of the internal structure of an image forming apparatus according to an embodiment of the present invention.

1Y, 1C, 1M, 1BK Unit
6Y, 6C, 6M, 6BK Image carrier
27 Casing
43 First locking member
44, 45 Arm portion
46 Coupling portion
51 Second locking member
55 Restricting member
63, 64 Guide portion

BEST MODE(S) OF CARRYING OUT THE INVENTION

Embodiments of a functional unit and an image forming apparatus including the functional unit according to the present invention will be explained in detail with reference to the accompanying drawings. The invention is not limited by the embodiments.

FIG. 1 is a schematic of an internal structure of an image forming apparatus. The image forming apparatus is a full color image forming apparatus. The image forming apparatus includes a main body 7, first to fourth units 1Y, 1C, 1M, and 1BK arranged in the main body 7, and an intermediate transfer belt 2 arranged to be opposed to the four units. The intermediate transfer belt 2 is spanned around a plurality of rollers 3, 4, and 5. The respective units 1Y to 1BK include image carriers 6Y, 6C, 6M, and 6BK, each constituted as a drum-shaped photoconductor. Toner images of different colors are formed on the respective image carriers. The units 1Y to 1BK are generally called a "process cartridge" which is a functional unit.

Configurations of the first to the fourth units 1Y to 1BK are substantially the same; moreover, configurations for transferring toner images formed on the respective image carriers to the intermediate transfer belt 2 are substantially the same except for difference in color among the toner images. Therefore, only the configuration of the first unit 1Y and the configuration for transferring a toner image on the image carrier 6Y to the intermediate transfer belt 2 are explained.

Figure 2:
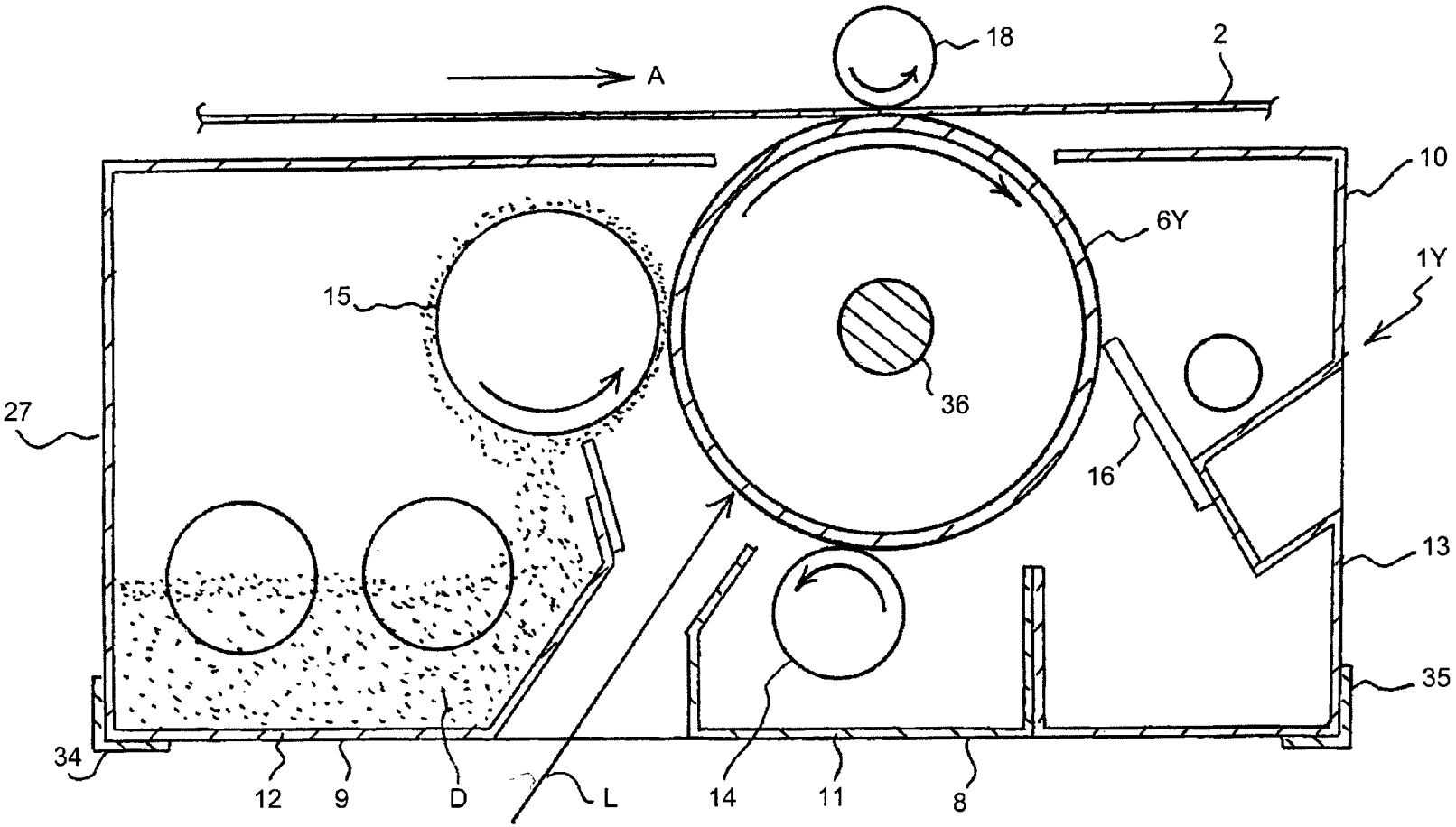
FIG. 2 is an enlarged schematic of a first unit shown in FIG. 1.

FIG. 2 is an enlarged schematic of the first unit 1Y. The unit 1Y shown in FIG. 2 includes a charging device 8, a developing device 9, and a cleaning device 10 arranged around the image carrier 6Y. Respective cases 11, 12, and 13 for the devices 8, 9, and 10 are integrally assembled by a unit frame (not shown in FIG. 1), and the image carrier 6Y is rotatably supported by the unit frame. The unit 1Y is thus constituted by integrally assembling the respective devices 8, 9, and 10 with the image carrier 6Y.

When an image forming operation is started, the image carrier 6Y is rotationally driven in a clockwise direction in FIG. 1 and FIG. 2, and the intermediate transfer belt 2 is rotationally driven in a direction of arrow A. At this time, a charge roller 14 rotationally supported by the case 11 of the charging device 8 is rotated in the direction of arrow while contacting with a surface of the image carrier 6Y, so that the image carrier 6Y is charged to predetermined polarity due to action of the charge roller 14. An optically modulated laser beam L emitted from an exposing device 17 shown in FIG. 1 as a device separated from the unit 1Y is irradiated on the charged image carrier 6Y, so that an electrostatic latent image is formed on the image carrier 6Y.

The developing device 9 has a developing roller 15 rotatably supported by the case 12, so that dry-type developer D is carried on the developing roller 15 rotating in a counterclockwise direction to be conveyed, yellow toner in the developer is electrostatically moved to an electrostatic latent image formed on the image carrier 6Y, and the latent image is visualized as a yellow toner image.

A primary transfer roller 18 is arranged on an opposite side of the unit 1Y across the intermediate transfer belt 2, and the toner image formed on the image carrier 6Y is transferred to the intermediate transfer belt 2 due to action of the primary transfer roller 18. Post-transfer remaining toner adhering on the image carrier 6Y after the toner image has been transferred is scraped and removed from the surface of the image carrier by a cleaning blade 16 supported by the case 13 of the cleaning device 10.

Similarly to the above, a cyan toner image, a magenta toner image, and a black toner image are formed on the second to the fourth units 1C, 1M, and 1BK, respectively, and these toner images are sequentially transferred in a superimposing manner on the intermediate transfer belt 2 with the transferred yellow toner image transferred thereon.

On the other hand, as shown in FIG. 1, a paper feed cassette 19 that accommodates recording media P, each being transfer paper, is disposed at a lower portion inside the image forming apparatus main body 7. The uppermost recording medium P is fed out in a direction of arrow B according to rotation of a paper feed roller 20. The fed out recording medium P is fed into between the intermediate transfer belt 2 and a secondary transfer roller 21 arranged to be opposed to the intermediate transfer belt 2. At this time, a toner image on the intermediate transfer belt 2 is transferred on the recording medium P according to action of the secondary transfer roller 21. The recording medium P on which the toner image is transferred further conveyed upwardly to pass through a fixing unit 22 where the toner image on the recording medium is fixed on the recording medium according to action of heat and pressure. The recording medium having passed through the fixing unit 22 is discharged to a paper discharge unit 23 at an upper portion of the image forming apparatus main body 7. Post-transfer remaining toner adhering on the intermediate transfer belt 2 after the toner image has been transferred is removed by a cleaning unit 24 for the intermediate transfer belt 2.

Figure 3:
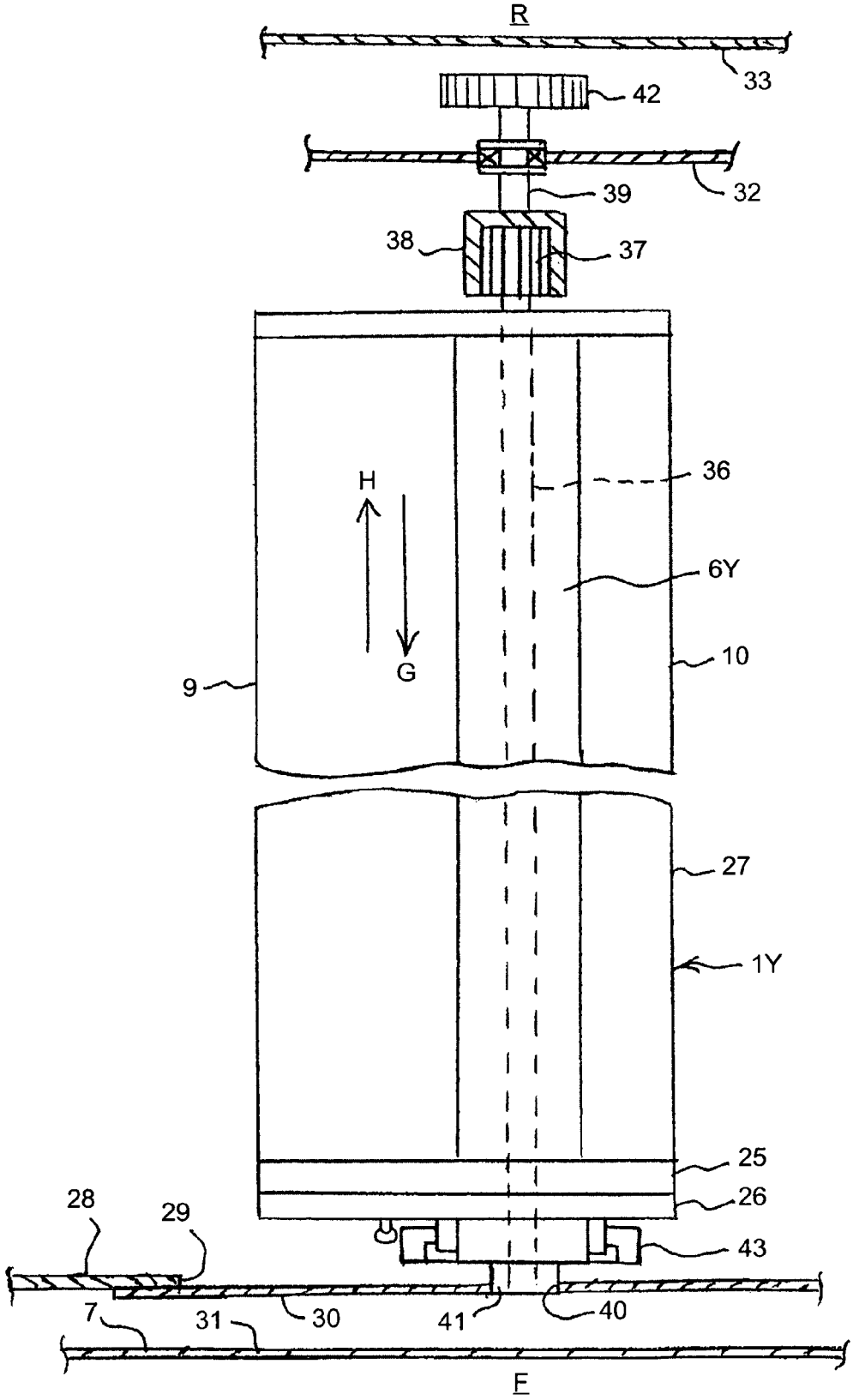
FIG. 3 is a plan view of a functional unit according to the embodiment.

FIG. 3 is a schematic partial sectional plan view of the unit 1Y set at a predetermined attaching position within the image forming apparatus main body 7. As explained with reference to FIG. 2, the charging device 8, the developing device 9, and the cleaning device 10 constituting the unit 1Y are assembled integrally by a unit frame 25 partially shown in FIG. 3, and the image carrier 6Y is rotatably supported by the unit frame 25.

A cover 26 is fixed to a front portion of the unit frame 25. In the image forming apparatus according to the embodiment, therefore, a casing 27 of the unit 1Y includes the case 11 for the charging device 8, the case 12 for the developing device 9, the case 13 for the cleaning device 10, the unit frame 25 for assembling these devices, and the cover 26 fixed to the unit frame 25. The casing of the unit can be constituted in other appropriate modes.

Reference symbol F in FIG. 3 indicates a front side of the image forming apparatus, while reference symbol R indicates an inner side, namely, a rear side of the image forming apparatus. The unit 1Y is detachably attached to the image forming apparatus main body 7 in front and rear directions, as described later. The image forming apparatus main body 7 has a front plate 28 arranged on the front side, a face plate 30 detachably fixed to the front plate 28 so as to cover an opening 29 formed in the front plate 28, and a front door 31 positioned at a side nearer to the front side than the face plate 30. The imaged forming apparatus main body 7 also includes an inner plate 32 arranged at the inner side and an exterior cover 33. The opening 29 can be opened by opening the front door 31 shown in FIG. 3 and detaching the front plate 28 from the face plate 30. When the unit 1Y is pulled to the front side in this state, the unit 1Y is drawn out to the front side, as shown with arrow G, while being guided by guide rails 34 and 35 as shown in FIG. 2. On the contrary, when the unit 1Y is pushed to the inner side, the unit 1Y is moved to the inner side while being guided by the guide rails 34 and 35, so that it is pushed into the innermost position shown in FIG. 3. Thus, the unit 1Y is detachably attached to the image forming apparatus main body 7 in front and rear directions shown with arrows G and H. Thus, the unit 1Y can be easily replaced with a new one, and maintenance work for the unit 1Y can be performed easily.

As shown in FIG. 3, a unit gear 37 is fixed to an end at the inner side of a shaft 36 fixedly supporting the image carrier 6Y, and a support shaft 39 of a cup-shaped gear 38 formed with internal teeth is rotatably supported by an inner plate 32 of the image forming apparatus main body 7 via a bearing. When the unit 1Y is pushed into the innermost position within the image forming apparatus main body toward the inner position direction thereof, as shown with arrow H in FIG. 3, the unit gear 37 fits with the cup-shaped gear 38, so that teeth of both the gears 37 and 38 mesh with each other. Thus, the unit 1Y is positioned regarding the front and rear directions of the image forming apparatus main body 7. As shown in FIG. 3, in this state, when the face plate 30 is fixed to the front plate 28, a bearing 41 attached at the front side end of the shaft 36 is fitted into a positioning hole 40 formed in the face plate 30. Thus, the unit 1Y is positioned regarding the upward and downward directions and the front and rear directions. The image forming operation can be started by closing the front door 31 in this state, as shown in FIG. 3.

A drive gear 42 is fixed to an inner side end of the support shaft 39 of the cup-shaped gear 38, and the drive gear 42 is rotationally driven by a motor (not shown) via an intermediate gear (not shown) during image forming operation, so that rotation of the drive gear 42 is transmitted to the image carrier 6Y via the support shaft 39, the cup-shaped gear 38, the unit gear 37, and the shaft 36, and the image carrier 6Y is rotationally driven as described above.

After the unit 1Y is pushed into the innermost position within the image forming apparatus main body, when the unit 1Y is deviated from the innermost position to the front side, the position of the unit 1Y is out of alignment so that an abnormal image can be formed or failure may occur in the image forming apparatus. Therefore, in the image forming apparatus of the embodiment, the unit 1Y can be locked at a predetermined attaching position within the image forming apparatus main body in the following manner.

Figure 4:
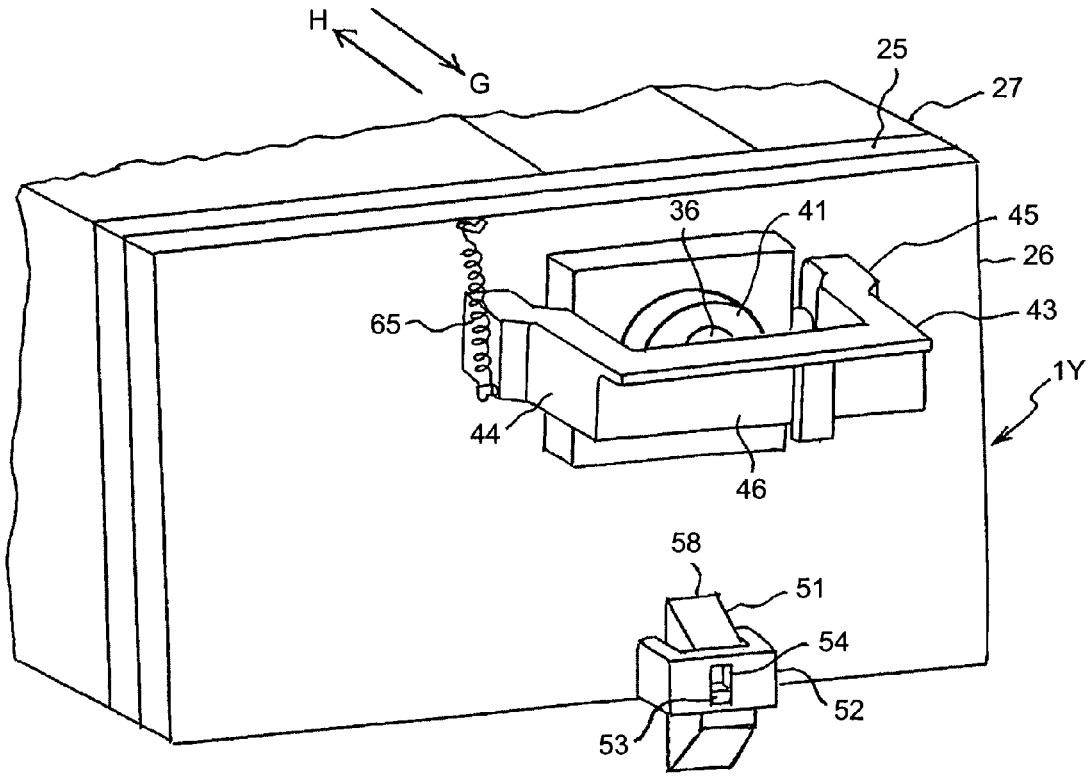
FIG. 4 is a perspective view of the functional unit which has been drawn out.
Figure 5:
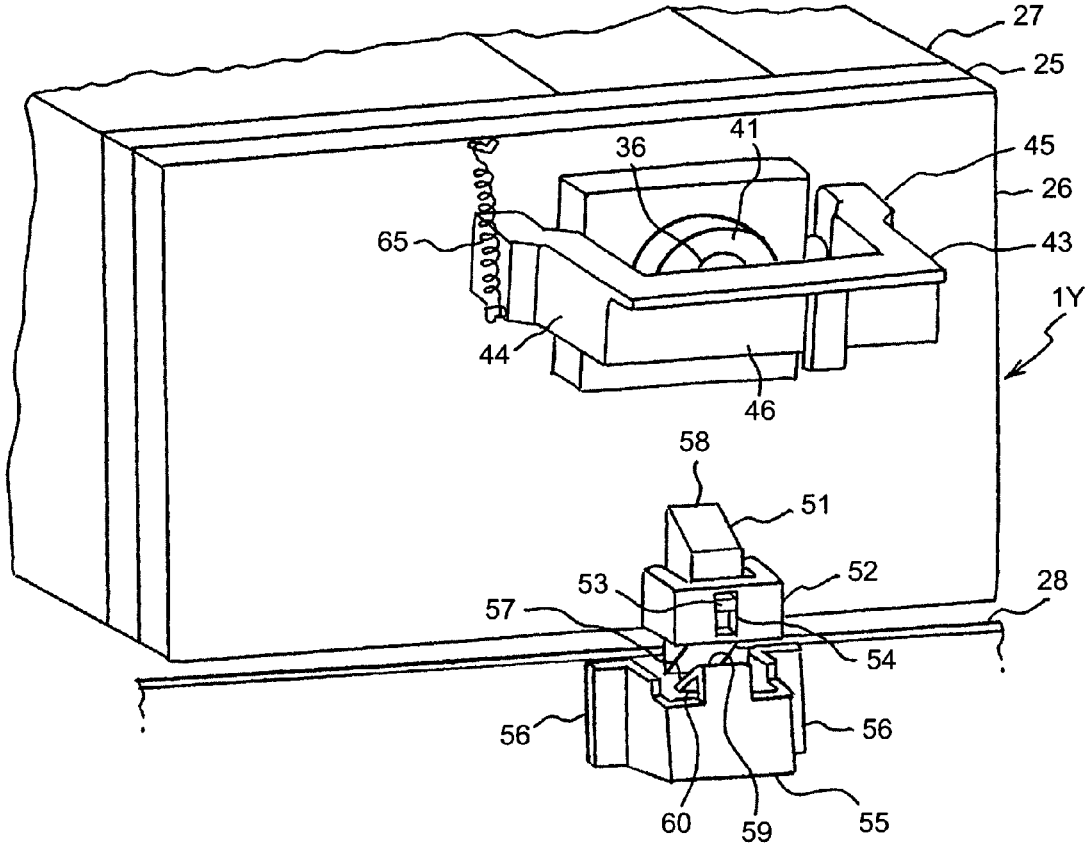
FIG. 5 is a perspective view of the functional unit which has been pushed into an innermost position within the image forming apparatus main body.
Figure 6:
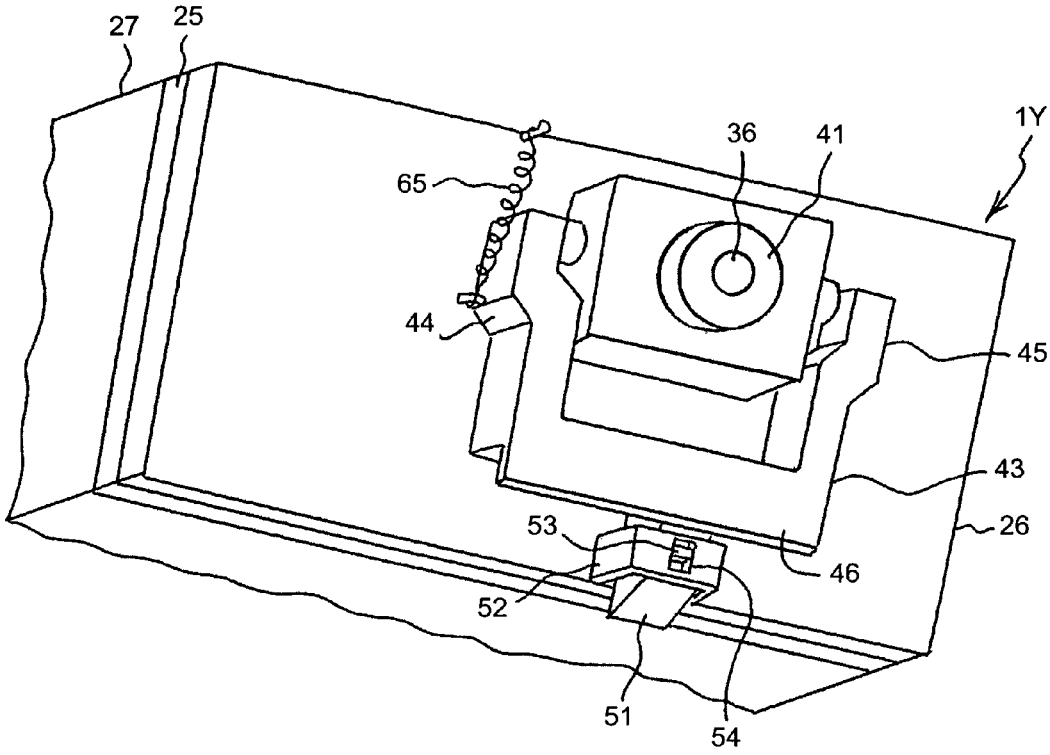
FIG. 6 is a perspective view of the functional unit which has been pushed into the innermost position within the image forming apparatus main body and a first locking member which has been pivoted at a locking position.
Figure 7:
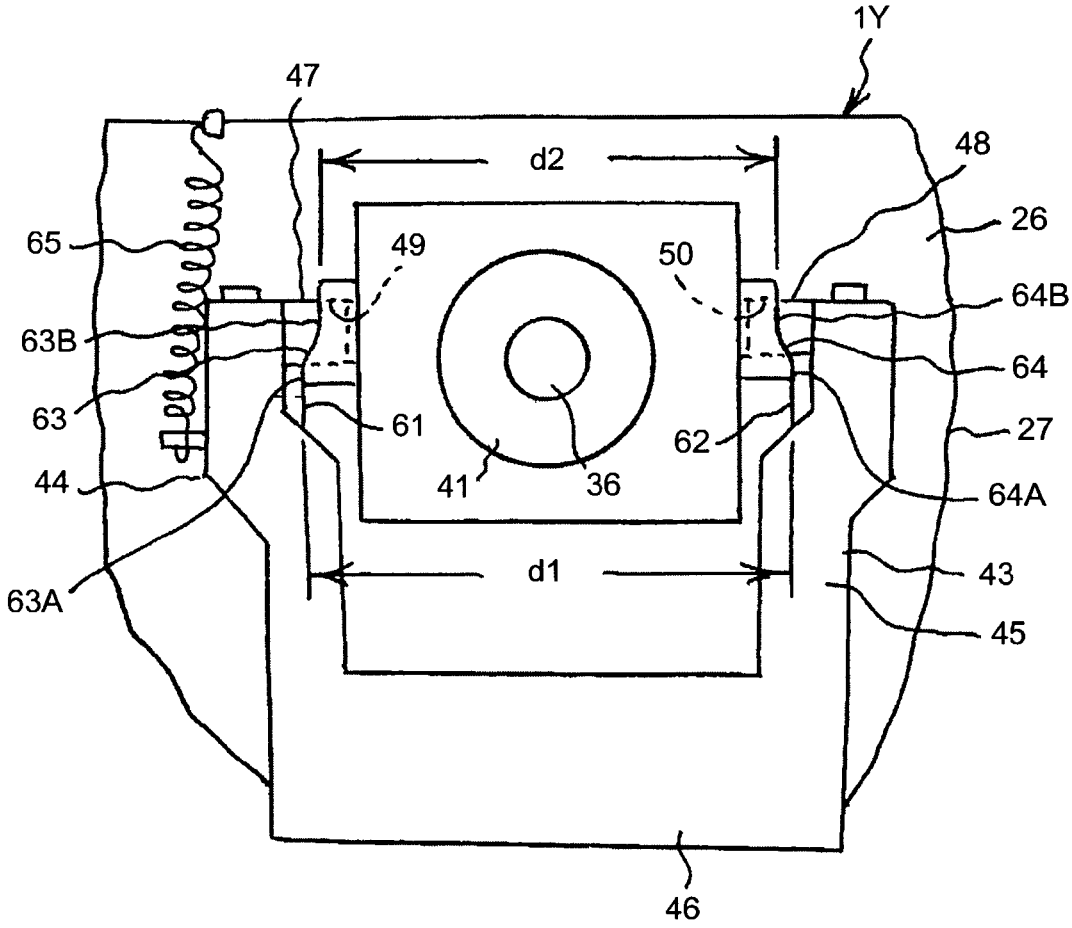
FIG. 7 is an explanatory diagram of a relationship between the first locking member and guide portions formed on a casing of the functional unit.
Figure 8:
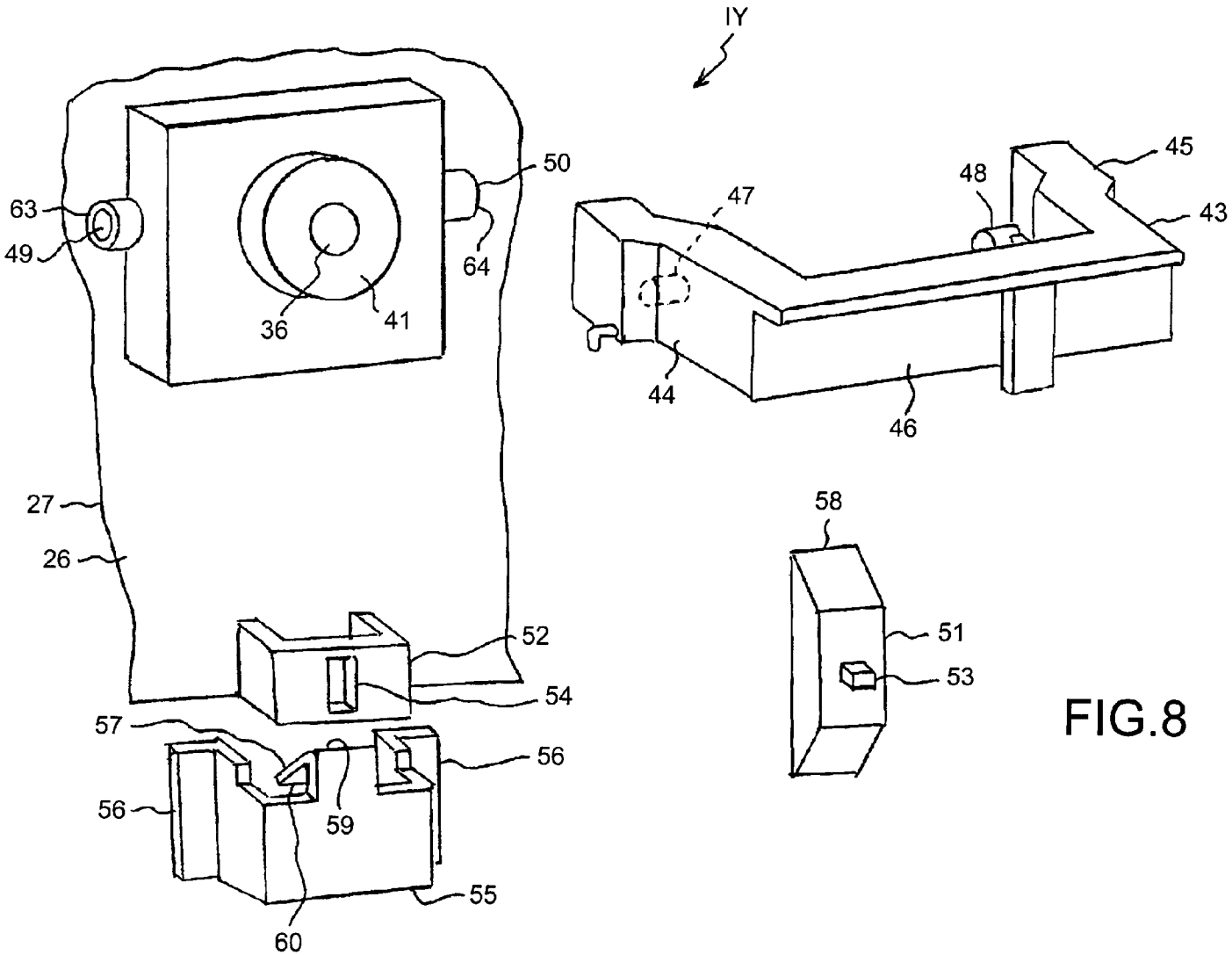
FIG. 8 is an exploded perspective view of the casing of the functional unit, the first locking member, and a second locking member separated from one another.

FIG. 4 to FIG. 7 are schematic views of the front side portion of the unit 1Y, and FIG. 8 is an exploded perspective view of the unit 1Y. FIG. 4 depicts the unit 1Y which has been drawn out to the front side, and FIG. 5 to FIG. 7 depict the unit 1Y which has been pushed into the innermost position within the image forming apparatus main body. As understood with reference to FIG. 4 to FIG. 8, a first locking member 43 is provided on, the cover 26 constituting the casing 27 of the unit 1Y. The first locking member 43 is formed of resin, and it includes a pair of arm portions 44 and 45 and a coupling portion 46 that couples the arm portions 44 and 45 to each other. As shown in FIG. 7 and FIG. 8, pins 47 and 48 are projectingly provided on proximal ends of the respective arm portions 44 and 45, and the respective pins 47 and 48 are pivotally fitted into mounting holes 49 and 50 formed in the cover 26 of the casing 27. Thus, the proximal ends of the respective arm portions 44 and 45 are pivotally coupled to the casing 27 of the unit 1Y, and the first locking member 43 is supported pivotally by the casing 27 between a locking position shown in FIG. 6 and FIG. 7 and an unlocking position shown in FIG. 4 and FIG. 5. The first locking member 43 is pivotally biased toward the unlocking position shown in FIG. 4 and FIG. 5 by a biasing unit described later.

On the other hand, a mounting portion 52 formed in a substantial U shape is provided on the cover 26, and a second locking member 51 is held by the mounting portion 52 movably in a vertical direction. A guide slot 54 extending vertically is formed in the mounting portion 52, and a projection 53 provided on the second locking member 51 is slidably fitted into the guide slot 54. The second locking member 51 is positioned below the first locking member 43, and it is held on the casing 27 movably in parallel in directions of approaching to and separating from the first locking member 43.

Figure 10:
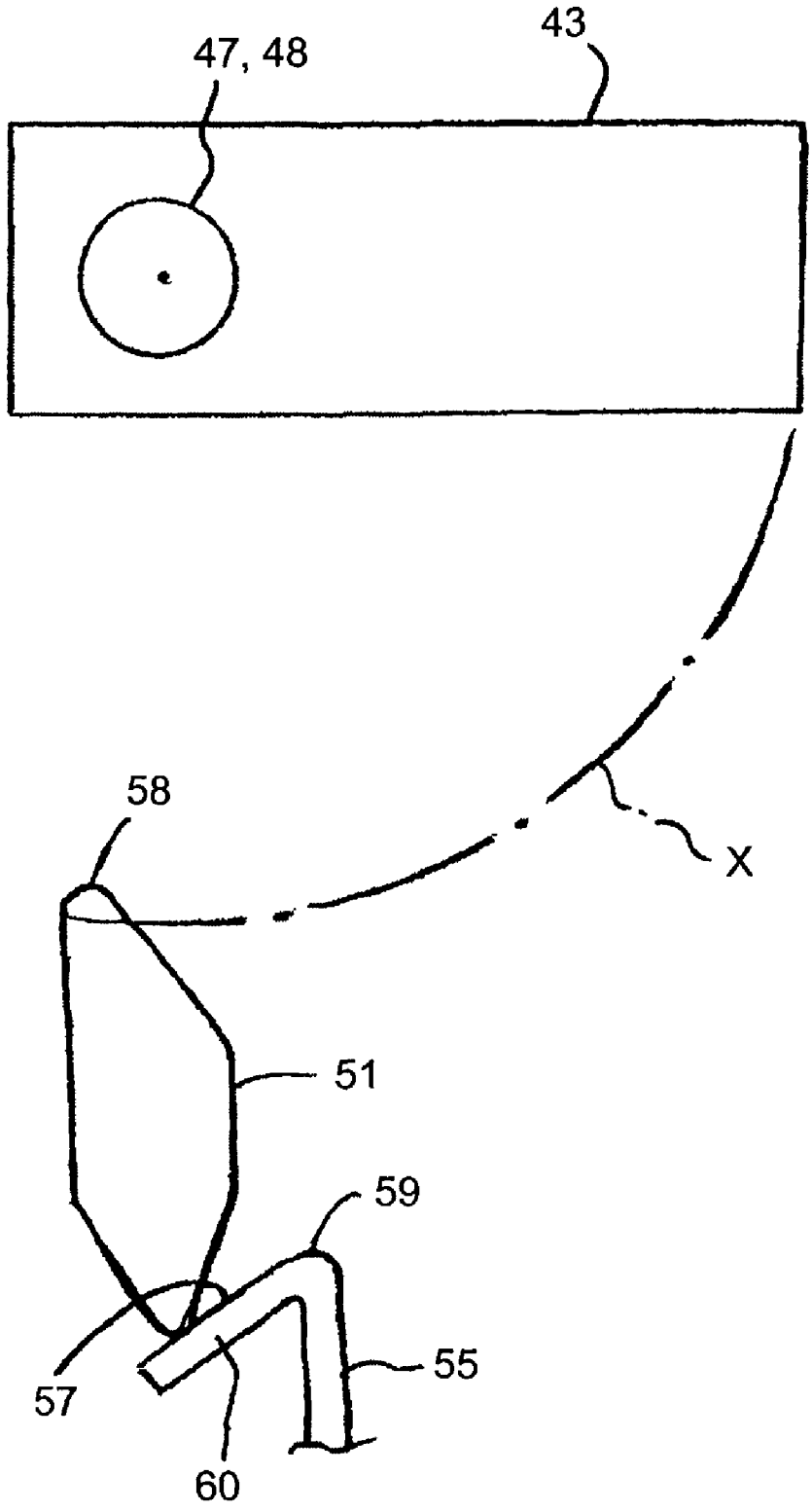
FIG. 10 is an explanatory diagram of a relative positional relationship between the first locking member and the second locking member when the functional unit is put in a state shown in FIG. 5.
Figure 11:
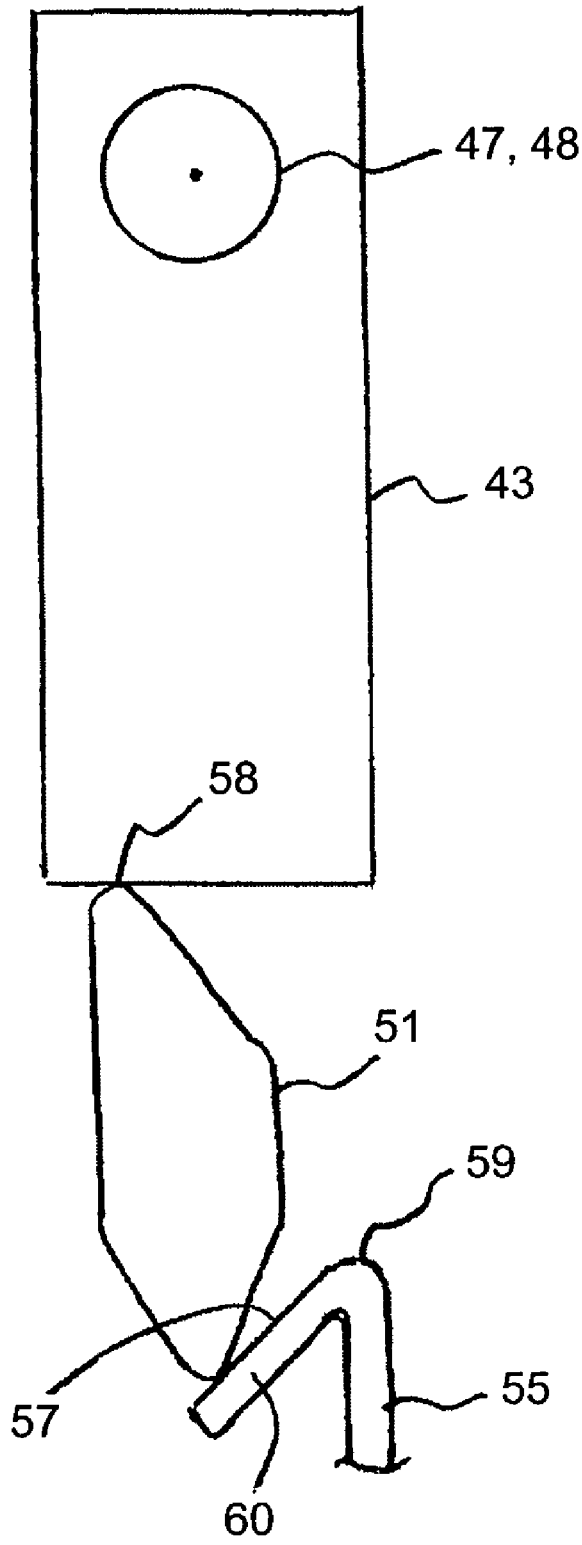
FIG. 11 is an explanatory diagram of a relative positional relationship between the first locking member and the second locking member when the functional unit is put in a state shown in FIG. 6.

As shown in FIG. 5 and FIG. 8, proximal portions 56 of a restricting member 55 formed of a plate spring made of, for example, metal is fixed to the front plate 28 constituting the image forming apparatus main body 7. As also shown in FIG. 10 and FIG. 11, the restricting member 55 has a tongue portion 60 including an inclination face 57 inclined obliquely downwardly from a top portion 59 toward the inner side of the image forming apparatus main body 7. The restricting member 55 is not shown in FIG. 6 and FIG. 7.

Figure 9:
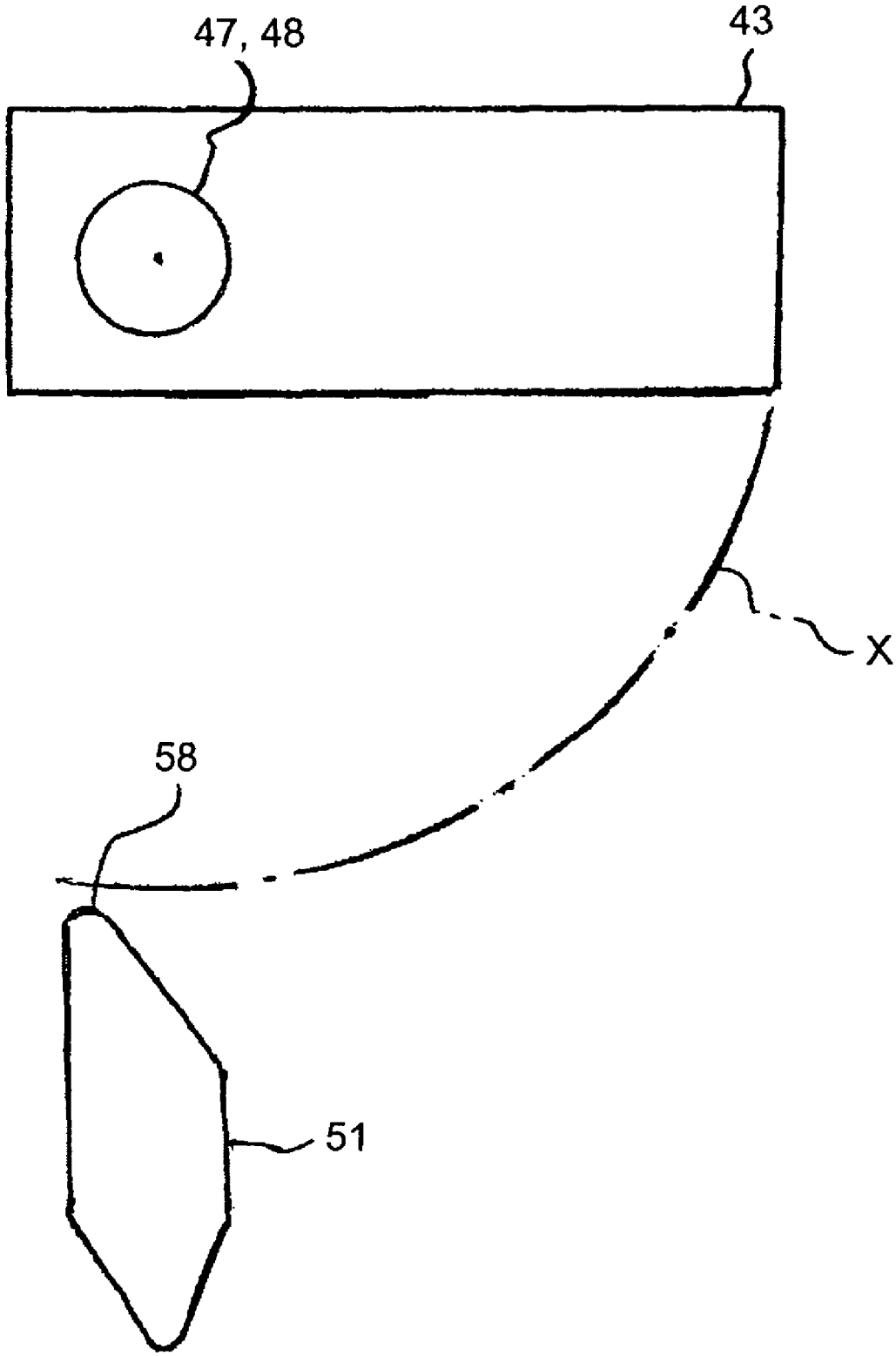
FIG. 9 is an explanatory diagram of a relative positional relationship between the first locking member and the second locking member when the functional unit is put in a state shown in FIG. 4.

As described above, FIG. 4 depicts the unit 1Y which has been drawn out from the innermost position within the image forming apparatus main body 7 to the front side position, and FIG. 9 depicts a relative positional relationship between the first locking member 43 and the second locking member 51 at that time. In this state, the first locking member 43 occupies the unlocking position where it projects toward the front side due to action of the biasing unit. On the other hand, the second locking member 51 occupies the lowermost position due to its self weight without engaging with the restricting member 55 shown in FIG. 5 and FIG. 8, so that an upper end 58 of the second locking member 51 is positioned below a pivoting locus X of the first locking member 43. Accordingly, even if the first locking member 43 in this state is grasped by a hand of an operator and is pivoted to the locking position shown in FIG. 6, the first locking member 43 does not contact with the second locking member 51, and when the first locking member 43 set at the locking position is released from the hand, the first locking member 43 is pivoted to the unlocking member shown in FIG. 4 and FIG. 9 due to action of the biasing unit. When the unit 1Y is drawn out to the front side and the second locking member 51 and the restricting member 55 are disengaged from each other in this manner, the first locking member 43 can be freely pivoted within a predetermined angular range between the locking position and the unlocking position.

When the unit 1Y shown in FIG. 4 is pushed in the direction of arrow H, the unit 1Y is moved toward the inner side of the image forming apparatus main body, and when the second locking member 51 gets over the top portion 59 of the restricting member 55 fixed on the front plate 28 of the image forming apparatus main body 7 and when the unit 1Y is pushed into the innermost position within the image forming apparatus main body 7 at this time, the second locking member 51 stops in a state that it is set above the inclined face 57 of the restricting member 55, as shown in FIG. 5 and FIG. 10. Thus, the second locking member 51 is lifted up to a position above the lowermost position thereof by the inclined face 57 of the restricting member 55 so that the upper end 58 of the second locking member 51 enters inside the pivoting locus X of the first locking member 43. Thus, when the unit 1Y is pushed into the innermost position within the image forming apparatus main body 7, the second locking member 51 is pushed in a direction of approaching to the first locking member 43 by the restricting member 55 provided on the image forming apparatus main body. Accordingly, when the first locking member 43 is pivoted to the locking position shown in FIG. 6 in this state, the first locking member 43 is brought in pressure contact with the upper end 58 of the second locking member 51, as shown in FIG. 11, so that the second locking member 51 is pressed down. Thus, the second locking member 51 and the inclined face 57 of the restricting member 55 are brought in pressure-contact with each other, so that the tongue portion 60 is elastically deformed downwardly.

As described above, the first locking member 43 frictionally engages with the second locking member 51, where the first locking member 43 is immovably held at the locking position, and the unit 1Y is locked to the image forming apparatus main body due to pressure-contact between the second locking member 51 and the restricting member 55. Since the unit 1Y is positioned regarding the upward and downward directions and the leftward and rightward directions by fixing the face plate 30 shown in FIG. 3 to the front plate 30 in this state, the unit 1Y is locked while it has been set at the predetermined attaching position. Unless the unit 1Y is pressed into the innermost position within the image forming apparatus main body at this time, the unit 1Y can not be locked, so that there is no possibility that the unit 1Y is locked at a wrong position. When the unit 1Y is not locked, the first locking member 43 occupies the unlocking position where it projects to the front side, so that an operator can immediately know whether the unit 1Y has been locked, thereby preventing forgetting to lock the unit 1Y. With this configuration, the unit 1Y can be prevented from moving to deviate from the predetermined attaching position, thereby preventing occurrence of an abnormal image or failure of the image forming apparatus. Since the unit 1Y is not pressed toward the inner side by the face plate 30, the face plate 30 is not applied with large external force from the unit 1Y, so that the face plate 30 is not deformed largely and positioning precision of the image carrier 6Y is not lowered.

As described above, in the unit 1Y according to the embodiment, the first locking member 43 and the second locking member 51 are arranged to the casing 27 such that, when the unit 1Y is drawn out to the front side and the second locking member 51 and the restricting member 55 are disengaged from each other, the first locking member 43 can be freely pivoted within the predetermined angular range. Further, when the first locking member 43 is pivoted to the locking position where it engages with the second locking member 51 pressed by the restricting member 55 while it has been pushed into the innermost position within the image forming apparatus main body, the first locking member 43 frictionally engages with the second locking member 51, where the first locking member 43 is held at the locking position, and the second locking member 51 and the restricting member 55 are brought in pressure contact with each other, so that the unit 1Y is locked to the image forming apparatus main body 7.

When the unit 1Y is drawn out to the front side or it is pushed into the inner side, the first locking member 43 occupying the unlocking position can be grasped by a hand of an operator, so that attaching and detaching operations of the unit 1Y can be performed easily. In the unit 1Y of the embodiment, thus, the first locking member 43 also serves as a handle grasped by the operator at attaching and detaching times of the unit 1Y. Thus, an exclusive handle is not required, so that the configuration of the unit 1Y can be simplified.

A specific example of the biasing unit that biases the first locking member 43 toward the unlocking position except for the locking position will be explained.

FIG. 7 is an explanatory diagram of the respective pins 47 and 48 projectingly provided on the respective arm portions 44 and 45 of the first locking member 43, pivotally fitted into the respective mounting holes 49 and 50 formed in the cover 26. As shown in FIG. 7, projections 61 and 62 are formed on the respective arm portions 44 and 45, and guide portions 63 and 64, on which the projections 61 and 62 of the first lock member 43 slide when the first locking member 43 is pivoted between the locking position and the unlocking position, are formed on portions of the cover 26 positioned adjacent to the respective mounting holes 49 and 50 (also see FIG. 8). The casing 27 of the unit 1Y has the guide portions 63 and 64 on which the respective arm portions 44 and 45 slide when the first locking member 43 is pivoted between the locking position and the unlocking position.

Assuming that a distance between portions 63A and 64A of the guide portions 63 and 64 on which the respective projections 61 and 62 abut when the first locking member 43 occupies the locking position shown in FIG. 7 is represented as d1, and a distance between portions 63B and 64B of the guide portions 63 and 64 on which the projections 61 and 62 abut when the first locking member 43 occupies the unlocking position is represented as d2, setting is made to satisfy d1>d2 and the distances gradually change. Therefore, when the first locking member 43 is in the locking position, the distances between both the arm portions 44 and 45 become the maximum, and when the first locking member 43 occupies the unlocking position, the distance between both the arm portions 44 and 45 becomes the minimum. When the first locking member 43 is pivoted from the unlocking position toward the locking position, the guide portions 63 and 64 guide both the arm portions 44 and 45 while elastically deforming both the arm portions 44 and 45 such that the distance between both the arm portions 44 and 45 gradually expands. As shown in FIG. 10, therefore, when the first locking member 43 frictionally engaging with the second locking member 51 to occupy the unlocking position is grasped by hand to be slightly pivoted toward the unlocking position and the frictional engagement of the first locking member 43 with the second locking member 51 is cancelled, the first locking member 43 pivots from the locking position toward the unlocking position due to its own elasticity while being deformed such that the distance between both the arm portions 44 and 45 decreases. The biasing unit that pivotally biases the first locking member 43 toward the unlocking position except for the locking position is configured in this manner. According to such a biasing unit, the first locking member 43 can be biased toward the unlocking position without providing a special member.

The guide portions can be constituted by plate springs abutting on the respective arm portions 44 and 45 instead of forming the guide portions 63 and 64 by the cover 26 itself.

As shown in FIG. 4 to FIG. 7, respective ends of a tension coil spring 65 are engaged with the first locking member 43 and the cover 26 so that the first locking member 43 can be biased toward the unlocking position by the tension coil spring 65. The first locking member 43 can be pivotally biased toward the unlocking position by a torsion coil spring instead of using the tension coil spring 65. Thus, the biasing unit can include a spring for biasing the first locking member 43 toward the unlocking position.

Although the first unit 1Y has been explained above, the other units 1C, 1M, and 1BK can also be configured similarly. The configuration according to the present invention can also be widely applied to an intermediate transfer unit and the like including units other than the unit having the image carrier on which a toner image is formed, for example, a fixing unit, a developing unit, a cleaning unit, and an intermediate transfer belt.

INDUSTRIAL APPLICABILITY

As described above, the functional unit and the image forming apparatus including the functional unit according to the present invention are useful in an image forming apparatus such as a copying machine, a printer, or a facsimile apparatus, and it is particularly suitable for an apparatus where a plurality of imaging units are unitized for detachably attaching to the apparatus and an improvement in operability of the respective functional units and reliability of setting the respective functional units are required.

The invention claimed is:

1. A functional unit that is detachably attached to a main body of an image forming apparatus by inserting into a hollow portion of the main body, comprising:

a casing;

a first locking member that is pivotally supported by the casing; and a second locking member that is supported by the casing to be movable in a direction of approaching or separating from the first locking member and is pressed in a direction of approaching to the first locking member by a restricting member provided on the main body when the functional unit is inserted into the hollow portion, wherein the first locking member and the second locking member are arranged in the casing such that, when the functional unit is drawn out of the main body, and the second locking member and the restricting member are disengaged from each other, the first locking member can freely pivot within a predetermined angular range, and when the first locking member is pivoted at a locking position where the first locking member engages with the second locking member pressed by the restricting member while the functional unit is inserted into the hollow portion, the first locking member frictionally engages with the second locking member where the first locking member is engaged at the locking position, and the second locking member and the restricting member come in pressure contact with each other, so that the functional unit is locked to the image forming apparatus main body, and wherein the restricting member includes a tongue portion having an inclination face inclined obliquely downwardly from a top portion toward an inner side of the image forming apparatus main body, and the second locking member is pressed in the direction of approaching the first locking member by running on the inclination face of the restricting member.

2. The functional unit according to claim 1, wherein the first locking member is in a form of a handle that allows grasping by an operator at the time of inserting and withdrawing the functional unit.

3. The functional unit according to claim 1, further comprising a biasing unit that biases the first locking member toward a position other than the locking position.

4. The functional unit according to claim 3, wherein the first locking member includes a pair of arm portions; and a coupling portion that couples the arm portions to each other, wherein proximal ends of the respective arm portions are pivotally coupled to the casing of the functional unit, the casing has guide portions on which the respective arm portions slide when the first locking member is pivoted between the locking position and the unlocking position, the guide portions guide both the arm portions such that a distance between both the arm portions gradually expands, when the first locking member is pivoted from the unlocking position toward the locking position, and the biasing unit is constituted by the guide portions.

5. The functional unit according to claim 4, wherein the biasing unit includes a spring that biases the first locking member toward the unlocking position.

6. The functional unit according to claim 1, further comprising an image carrier on which a toner image is formed.

7. An image forming apparatus including the functional unit according to claim 1.

8. A functional unit that is detachably attached to a main body of an image forming apparatus by inserting into a hollow portion of the main body, comprising:

a casing;

a first locking member that is pivotally supported by the casing;

a second locking member disposed on the casing such that it is movable toward or away from the first locking member; and a restricting member disposed on the main body such that upon fully inserting the functional unit into the hollow portion, the second locking member frictionally engages the restricting member, whereby the second locking member moves toward the first locking member, wherein the first locking member and the second locking member are arranged in the casing such that, in an unlocked position, the second locking member and the restricting member are disengaged from each other, and the first locking member is spaced apart from the second locking member such that the first locking member can freely pivot within a predetermined angular range, and in a locked position, the first locking member is pivoted, such that an edge of the first locking member engages an upper portion of the second locking member, and a bottom portion of the second locking member is frictionally engaged with the restricting member.

9. The functional unit according to claim 8, wherein the first locking member is in a form of a handle that allows grasping by an operator at the time of inserting and withdrawing the functional unit.

10. The functional unit according to claim 8, further comprising a biasing unit that biases the first locking member toward a position other than the locked position.

* * * * *